US006364728B1

(12) United States Patent
Viale et al.

(10) Patent No.: US 6,364,728 B1
(45) Date of Patent: Apr. 2, 2002

(54) SWIMMING FLIPPER WITH CONTROLLED-FLEXIBILITY BLADE

(75) Inventors: Mario Viale, Chiavari; Giovanni Garofalo, Rapallo, both of (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/655,829

(22) Filed: Sep. 6, 2000

(30) Foreign Application Priority Data

Sep. 8, 1999 (IT) ..... GE99A0107

(51) Int. Cl.[7] ..... A63B 31/08
(52) U.S. Cl. ..... 441/64
(58) Field of Search ..... 441/61, 64; D12/806

(56) References Cited

U.S. PATENT DOCUMENTS

| | | | | | |
|---|---|---|---|---|---|
| 3,082,442 A | | 3/1963 | Cousteau et al. | | |
| 3,171,142 A | | 3/1965 | Auzols | | |
| 3,913,158 A | * | 10/1975 | Vilarrubis | 441/64 | |
| 4,737,127 A | * | 4/1988 | Lamont | 441/64 | |
| 5,183,424 A | * | 2/1993 | Field | 441/64 | |
| 5,304,081 A | * | 4/1994 | Takizawa | 441/64 | |
| 5,358,439 A | * | 10/1994 | Paolo | 441/64 | |
| D415,811 S | * | 10/1999 | Chen | D21/806 | |

FOREIGN PATENT DOCUMENTS

| | | | | |
|---|---|---|---|---|
| CH | 351204 | * | 2/1961 | 441/64 |
| FR | 1 208 636 | | 2/1960 | |
| FR | 2455905 | * | 1/1981 | 441/64 |
| GB | 1284765 | * | 8/1972 | 441/64 |

* cited by examiner

*Primary Examiner*—S. Joseph Morano
*Assistant Examiner*—Andrew Wright
(74) *Attorney, Agent, or Firm*—Larson & Taylor, PLC

(57) ABSTRACT

A swimming flipper includes a shoe portion and a blade portion. Two ribbings are provided along the outer lateral edges of the flipper and include substantially V-shaped carvings. The V-shaped carvings are placed at a suitable distance from the front of the blade portion, and are arranged to create two bending lines of the blade portion. Limiting elements are provided on the upper surface of the blade portion which limit the bending movement thereof.

7 Claims, 3 Drawing Sheets

SWIMMING FLIPPER WITH CONTROLLED-FLEXIBILITY BLADE

BACKGROUND OF THE INVENTION

The present invention relates to a swimming flipper, and in particular to a flipper in which at least one blade portion shows a certain degree of controlled flexibility with respect to the shoe of the flipper itself.

In flipper swimming the thrust obtained by means of the flipper is not due to the whole movement made by the swimmer's foot, but only to the stage in which his/her leg is bending. The other stage, known as passive stage, therefore causes an extra labour for the diver, with no advantages from the point of view of movement. This negative aspect is even more evident with commonly used flippers, in which the blade portion is made of a relatively stiffer material; such configuration, though being advantageous on the one hand because it improves the thrusting power of the flipper, increases, on the other hand, the useless expenditure of energy in the so-called passive stage.

Therefore, it has been thought to reduce the diver's effort considerably during this stage, by conveying a certain degree of controlled flexibility to the flippers, that is to say, by making them flexible only during the passive stage.

In our co-pending U.S. patent application Ser. No. 09/431775 filed on Nov. $2^{nd}$ 1999 and assigned to the same Assignee, a swimming flipper is described whose blade is hinged onto the shoe so as to show a controlled degree of flexibility.

Another solution concerning this includes two carvings, substantially V-shaped, on each of the lateral ribbings stiffening the blade, said carvings being placed above and below the plane of the blade itself, one opposite the other and arranged so as to create on the blade plane a bending line, which is located near the shoe of the flipper itself, perpendicularly to the longitudinal axis of the flipper. However, the bending control only depends on the power of reciprocal contrast between the sloping surfaces of the carvings, said power being rather limited and therefore effective to a limited degree for this purpose. Moreover, the blade area where the bending takes place is extremely weakened.

SUMMARY OF THE INVENTION

The present invention aims at providing a swimming flipper having said controlled flexibility for the blade, without hinging the latter to the shoe, that is to say, without carrying out the sole portion of the shoe and the blade separately and connecting them afterwards.

The object of the present invention is to provide a swimming flipper which includes a shoe portion and a blade portion. The blade portion has upper and lower surfaces. Two ribbings are provided along the outer lateral edges of said flipper, said ribbings having an upper edge above the upper surface and a lower edge below the lower surface of the blade portion, and decreasing height towards the free end of said blade portion, characterised in that two carvings, substantially V-shaped, are provided on each of said ribbings near the shoe portion of said flipper, above and below the plane of the blade portion, said ribbings being placed at a suitable distance and staggered one with respect to the other, so as to create two bending lines for the plane of said blade, and limiting means for the bending being provided on the upper surface of said blade portion of the flipper.

Said carvings are advantageously carried out on each ribbing, placed at a distance one from the other so that the point of maximum depth of one carving corresponds to one of the points of minimum depth of the other carving. In particular, the configuration in which the carving above the blade plane is turned towards the free end of the blade seems to be more effective.

In accordance with another aspect of the present invention, the upper and lower edges of the ribbings are coated along their entire length with beads made of elastomeric material. The elastomeric material ensures the elastic response to the bending movements and therefore reduces the load placed onto the blade portion participating in the movements.

BRIEF DESCRIPTION OF THE DRAWINGS

Further advantages and features will be evident from the following description of some forms of embodiment of the swimming flipper according to the present invention, carried out as a mere non limiting example, referring to the enclosed drawings, where.

DESCRIPTION OF THE PREFERRED EMBODIMENTS OF THE INVENTION

Figure 1:
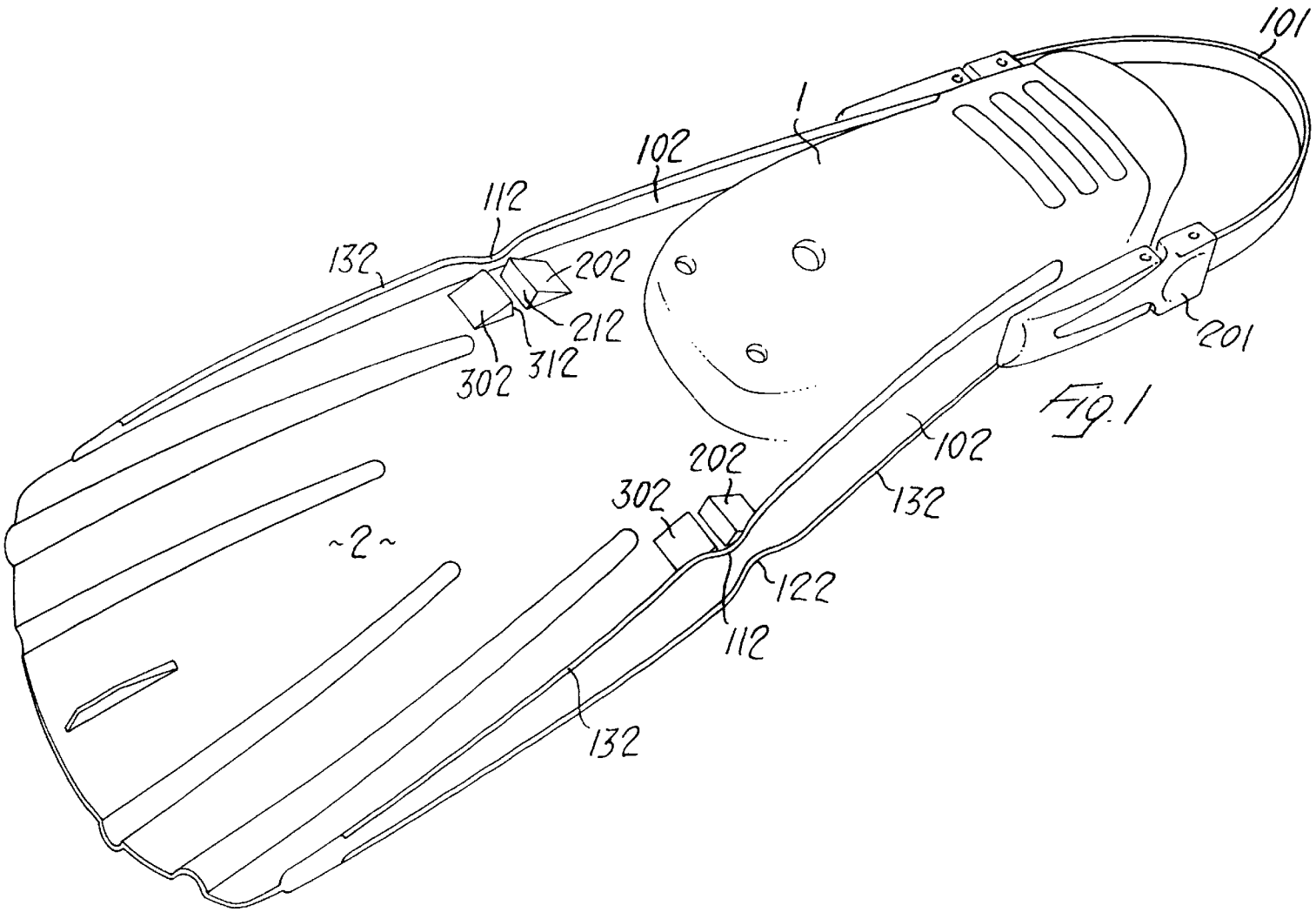
FIG. 1 is a perspective view of a first form of embodiment of the flipper according to the present invention

FIG. 1 shows a swimming flipper according to the present invention; the numeral 1 indicates the shoe portion of said flipper, provided with the heel belt 101 connected to the buckles 201. The flipper includes the blade portion 2, along whose lateral rims there are the ribbings 102 going up along a substantial portion of the shoe 1. Such ribbings are symmetrical to the plane of the blade 2, and their height decreases towards the free ends of said blade. On both ribbings 102 the carvings 112 and 122 are provided above and below the plane of the blade 2 and near the portion of the shoe 1, said carvings being substantially V-shaped and with a blunted vertex. Beads 132 made of elastomeric material are provided on both rims, the lower and the upper one of each ribbing. The blocks 202, 302 are located, obtained as one piece or applied onto the upper surface of the blade 2, in the area corresponding to the one which contains the carvings 112, 122 and near the ribbings 102. The blocks 202, 302 show flat surfaces 212, 312, one opposite the other and inclined with a given angle with respect to the plane of the blade 2.

Figure 2:
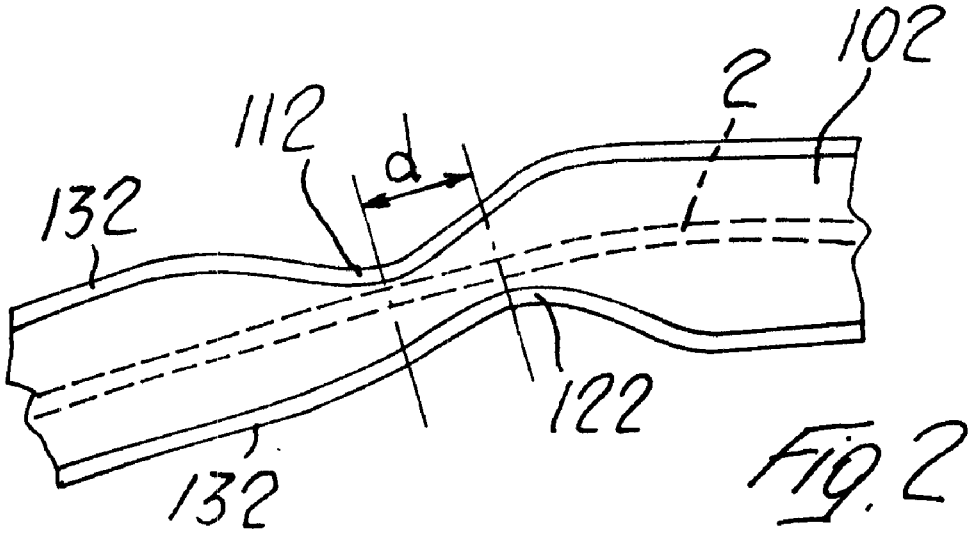
FIG. 2 is an enlarged detail in lateral elevation of the flipper in FIG. 1.

From FIG. 2 it is possible to verify that in each of the ribbings 102, the carving 112 above the plane of the blade 2 and the carving 122 below such plane are not placed opposite each other. As a matt er of fact, the axes of the two carvings are loca ted at such a distance d that the point of maximum depth of the carving 112 corresponds to a point of minimum depth of the carving 122, the carving 112 being turned toward s the free end of the blade 2.

Figure 3:
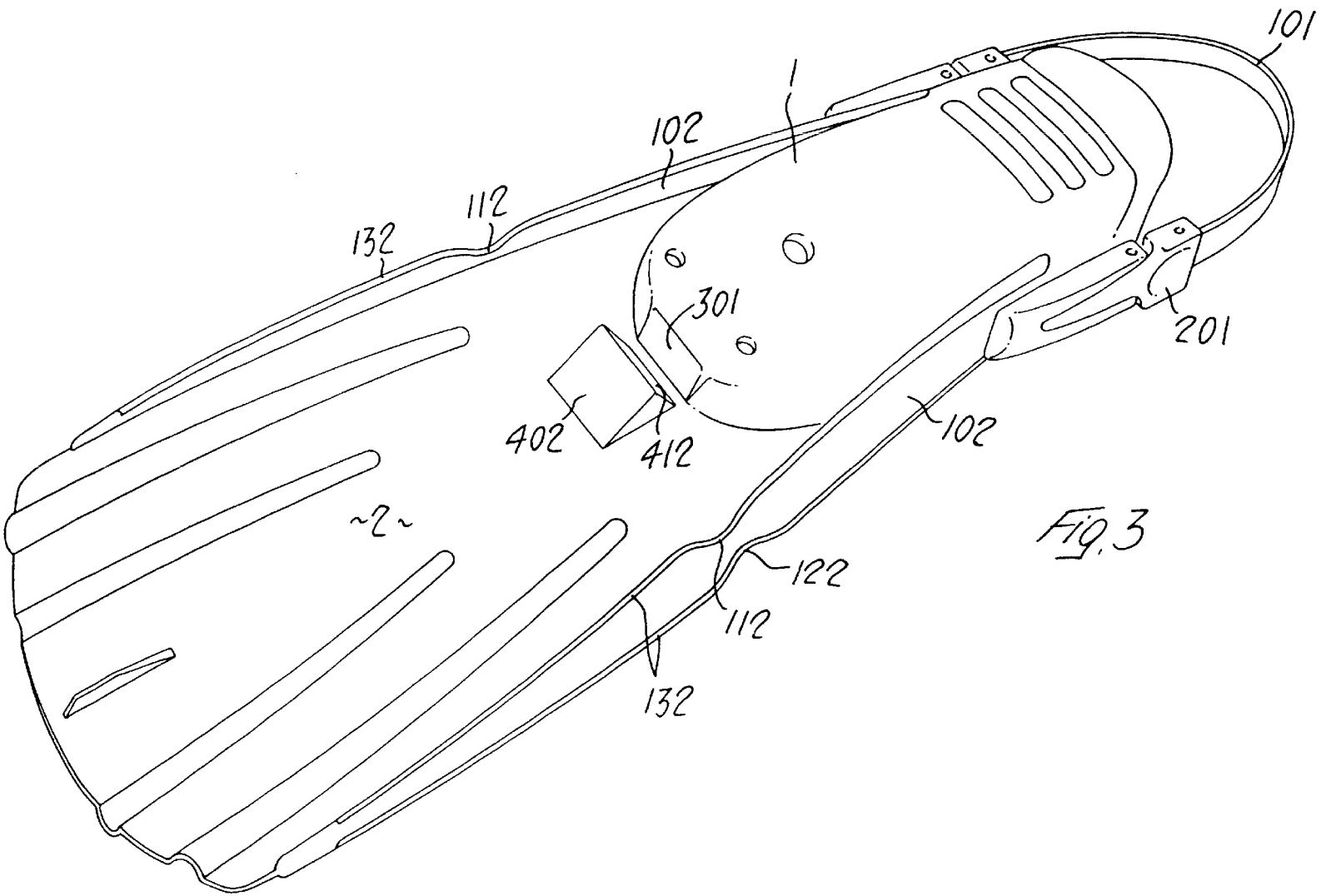
FIG. 3 is an execution variant of the flipper according to the present invention.

FIG. 3 shows an execution variant of the swimming flipper according to the invention; the same parts are indicated with the same numerals. A single block 402, obtained integrally with or applied to said blade 2, is centrally placed on the upper surface of said blade 2. Such block is opposite a levelling surface 301, obtained on the front end of the shoe 1. Both the levelling surface 301 and the flat surface 412 of the block 402 are inclined so as to limit the bending of the blade 2.

The working of the flipper according to the present invention will be evident from what follows. The carvings 112, 122 located on the ribbings 102 allow the blade to bend in the area between the lines connecting the axes of said carvings. Such area, though limited in its breadth, is nevertheless broader than a mere line, thus ensuring a better resistance to the bending load. Moreover, said resistance is increased by the beads 132 made of elastomeric material, working as elements of elastic response.

The distance d between the axes of the Carvings is established considering a minimum value, below which the two carvings would practically be one opposite the other and the structure of the blade 2 would be weakened, and a maximum value, above which there would be no interaction between the two carvings in the bending movement of said blade. Moreover, also the inclination of the lateral walls of said carvings 112, 122 must be such as to promote the bending movement without endangering the structural integrity of the blade. In practice, there is an angle 20° to 45° between the plane of the blade 2 and the lateral wall of the carving.

The limiting means for the bending movement during the active stage of flipper swimming, that is to say, the blocks 302 and 202 in the form of embodiment of FIG. 1 and the block 402 and the levelling surface 301 on the front end of the shoe 1 are shaped so as to limit the bending angle of the blade. The flat surfaces bound to come into contact reciprocally are inclined with respect to the plane of the blade so as to limit as much as possible the bending range during the passive stage of flipper swimming; the angle between said surfaces and the plane of the blade 2 is preferably of 60–80°.

We claim:

1. A swimming flipper comprising a shoe portion and a blade portion, said blade portion having a free end opposite from the shoe portion, the blade portion lying in a plane and having upper and lower surfaces, two ribbings, one of the ribbings extending along the outer lateral edges of the flipper, the other of the ribbings extending along a second outer lateral edge of the flipper, each ribbing having an upper edge above the upper surface and a lower edge below the lower surface, and defining a height from the upper edge to the lower edge, said height decreasing toward the free end of the blade portion, two substantially V-shaped carvings formed in each ribbing, including an upper carving formed into the upper edge and a lower carving formed into the lower edge, the bottom vertice of each carving being rounded and the lateral walls of said carvings being inclined relative to the plane of the blade portion at an angle of between 20° and 45°, one of the pair of upper carvings or the pair of lower carvings being located closer to the free end of the blade portion than the other pair of carvings, the pair of upper carvings of the two ribbings lying across the blade portion from each other to form a first bending line of the blade portion and the pair of lower carvings of the two ribbings lying across the blade portion from each other to form a second bending line of the blade portion, the upper and lower edges of said ribbings being coated along their entire length with beads made of elastomeric material and limiting means provided on the upper surface of the blade portion, which limiting means has facing surfaces positioned to engage each other to limit bending of the blade portion.

2. A swimming flipper according to claim 1, wherein said carvings on each ribbing are located such that the point of maximum depth of one carving is directly across that ribbing from a point of minimum depth of the other carving.

3. A swimming flipper according to claim 1, wherein said limiting means for limiting the bending movement of said blade portion includes at least a pair of limiting elements, on the upper surface of said blade portion, near said bending lines, the facing surfaces being opposite one another, flat and inclined at a given angle with respect to the upper surface of said blade portion.

4. A swimming flipper according to claim 3,wherein said limiting means includes two pairs of limiting elements, each of them being located near one of the ribbings.

5. A swimming flipper according to claim 4, wherein one of said facing surfaces is located on the front of the shoe portion, and the other facing surface is located opposite to the first facing surface.

6. A swimming flipper according to claim 1, in which said opposite facing surfaces of said limiting means are inclined with respect to the upper surface of the blade portion at an angle of about 60–80°.

7. A swimming flipper according claim 1, wherein the upper carvings are located closer to the free end of the blade portion than the lower carvings.

* * * * *